US008056326B2

(12) United States Patent
Cox et al.

(10) Patent No.: US 8,056,326 B2
(45) Date of Patent: Nov. 15, 2011

(54) REGENERATION DEVICE HAVING COOLED INJECTION HOUSING

(75) Inventors: Glenn B. Cox, Peoria, IL (US); Thomas R. McClure, Washington, IL (US); Robert L. Miller, Dunlap, IL (US); Stephen M. Wiley, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 1063 days.

(21) Appl. No.: 11/892,727

(22) Filed: Aug. 27, 2007

(65) Prior Publication Data

US 2008/0295500 A1 Dec. 4, 2008

Related U.S. Application Data

(60) Provisional application No. 60/924,788, filed on May 31, 2007.

(51) Int. Cl.

| | |
|---|---|
| ***F01N 3/00*** | (2006.01) |
| ***F01N 3/10*** | (2006.01) |
| ***F01N 3/02*** | (2006.01) |
| ***F01N 5/02*** | (2006.01) |
| ***B05B 1/24*** | (2006.01) |
| ***B05B 7/16*** | (2006.01) |
| ***B05B 15/00*** | (2006.01) |
| ***B05C 1/00*** | (2006.01) |
| ***F23D 11/44*** | (2006.01) |
| ***F23D 14/66*** | (2006.01) |

(52) U.S. Cl. ..... 60/295; 60/286; 60/303; 60/320; 239/128; 239/132; 239/132.3

(58) Field of Classification Search ..... 60/273, 60/286, 295, 297, 303, 320; 239/5, 127.1, 239/127.3, 128, 129, 132, 132.3, 132.5
See application file for complete search history.

(56) References Cited

U.S. PATENT DOCUMENTS

| | | | | |
|---|---|---|---|---|
| 1,875,457 | A | | 9/1932 | Hemmingsen |
| 2,286,658 | A | | 6/1942 | Voit |
| 2,965,303 | A | * | 12/1960 | Jackson ..... 239/132.5 |
| 3,586,732 | A | * | 6/1971 | Guth et al. ..... 585/656 |
| 5,195,362 | A | | 3/1993 | Eason |
| 5,345,913 | A | | 9/1994 | Belshaw et al. |
| 5,400,968 | A | | 3/1995 | Sood |
| 5,577,386 | A | | 11/1996 | Alary et al. |
| 5,961,154 | A | * | 10/1999 | Williams et al. ..... 285/22 |
| 6,279,603 | B1 | | 8/2001 | Czarnik et al. |
| 6,805,849 | B1 | | 10/2004 | Andreasson et al. |
| 6,814,303 | B2 | | 11/2004 | Edgar et al. |

(Continued)

FOREIGN PATENT DOCUMENTS

JP 2002098000 4/2002

*Primary Examiner* — Thomas Denion
*Assistant Examiner* — Audrey Klasterka
(74) *Attorney, Agent, or Firm* — Finnegan, Henderson, Farabow, Garrett & Dunner LLP

(57) ABSTRACT

A regeneration device for use in an exhaust treatment system is disclosed. The regeneration device has a first housing with a plurality of passages configured to receive coolant and injection fluid. A second housing is secured to the first housing and configured to receive coolant and injection fluid. The second housing has at least one cooling recess annularly disposed within the second housing to receive and circulate coolant in proximity to a tip end of the second housing.

15 Claims, 4 Drawing Sheets

U.S. PATENT DOCUMENTS

| | | | | |
|---|---|---|---|---|
| 7,021,047 | B2 * | 4/2006 | Hilden et al. | 60/286 |
| 7,168,241 | B2 | 1/2007 | Rudelt et al. | |
| 2004/0098980 | A1 * | 5/2004 | Montreuil et al. | 60/295 |
| 2005/0210869 | A1 * | 9/2005 | Rudelt et al. | 60/286 |
| 2007/0000242 | A1 * | 1/2007 | Harmon et al. | 60/295 |

* cited by examiner

REGENERATION DEVICE HAVING COOLED INJECTION HOUSING

This application is based on and claims the benefit of priority from U.S. Provisional Application No. 60/924,788, filed May 31, 2007, the contents of which are expressly incorporated herein by reference.

TECHNICAL FIELD

The present disclosure is directed to a regeneration device and, more particularly, to a regeneration device having a cooled injection housing.

BACKGROUND

Engines, including diesel engines, gasoline engines, gaseous fuel powered engines, and other engines known in the art exhaust a complex mixture of air pollutants. These air pollutants include solid material known as particulate matter or soot. Due to increased attention on the environment, exhaust emission standards have become more stringent and the amount of particulate matter emitted from an engine is regulated depending on the type of engine, size of engine, and/or class of engine.

One method implemented by engine manufacturers to comply with the regulation of particulate matter exhausted to the environment has been to remove the particulate matter from the exhaust flow of an engine with a device called a particulate trap. A particulate trap is a filter designed to trap particulate matter and typically consists of a wire mesh or ceramic honeycomb medium. However, the use of the particulate trap for extended periods may cause the particulate matter to build up in the medium, thereby reducing the functionality of the filter and subsequent engine performance.

The collected particulate matter may be removed from the filter through a process called regeneration. To initiate regeneration of the filter, the temperature of the particulate matter entrained within the filter must be elevated to a combustion threshold, at which the particulate matter is burned away. One way to elevate the temperature of the particulate matter is to inject fuel into the exhaust flow of the engine and ignite the injected fuel. During the regeneration event, fuel may flow through a supply circuit to the injection nozzle to support combustion of the particulate matter.

After the regeneration event, the supply of fuel is shut off. However, some fuel may remain in the fuel supply circuit and the injection nozzle. This remaining fuel, when subjected to the harsh conditions of the exhaust stream may coke or be partially burned, leaving behind a solid residue that can restrict or even block the injection nozzle and passages of the supply circuit. For this reason, it may be necessary to cool the injection nozzle during and between regeneration events.

One method of cooling an injection nozzle is described in U.S. Pat. No. 5,577,386 (the '386 patent) issued to Alary et al. on Nov. 26, 1996. Specifically, the '386 patent discloses high and low powered injectors used to inject fuel into the exhaust flow of a turbine engine. The high and low powered injectors are connected together in series to circulate fuel and coolant. Fuel is directed through an annular cavity leading to the high-powered injector, and then injected into an exhaust flow via a plurality of injection orifices. Fuel is also directed, as a coolant, through a blind bore in the high-powered injector. From the high-powered injector, the coolant is distributed by way of six separate channels to injection orifices of the low-powered injector to be injected into the exhaust flow as a fuel.

In this manner, the high-powered injector, when not in use, can be cooled by the fuel flowing to and injected by the low-powered injector.

Although the injection nozzle of '386 patent may benefit somewhat from the cooling process described above, it is designed primarily for high-powered fuel injection associated with a turbine engine. As such, the injection nozzle of the '386 patent may have limited applicability for use in an internal combustion engine, and more specifically, for use in a regeneration device associated with an exhaust flow of an internal combustion engine. In particular, a regeneration device may have little use for dual injectors, or even a single high-powered injector. Moreover, even if the injectors of the '386 patent could be used with a regeneration device, it may be impractical because of the complexity and expense of the design. Furthermore, the use of fuel as a coolant may be problematic for an injector influenced by the high temperatures of an internal combustion engine's exhaust stream. These high temperatures may coke the fuel within the high-powered injector when it is not in use, causing both the coolant and the fuel passages to clog.

The regeneration device of the present disclosure solves one or more of the problems set forth above.

SUMMARY OF THE INVENTION

One aspect of the present disclosure is directed to a regeneration device having a first housing and an second housing secured to the first housing. The housing may be configured to receive coolant and an injection fluid. The second housing may be configured to receive coolant and the injection fluid from the first housing. The second housing may have at least one cooling recess annularly disposed within the second housing to receive and circulate coolant in proximity to a tip end of the second housing.

Another aspect of the present disclosure is directed to a method of cooling a regeneration device. The method may include pressurizing a flow of coolant and directing the flow of coolant through a first housing to a second housing. The method may further include thermally isolating the second housing from the first housing.

DETAILED DESCRIPTION

Figure 1:
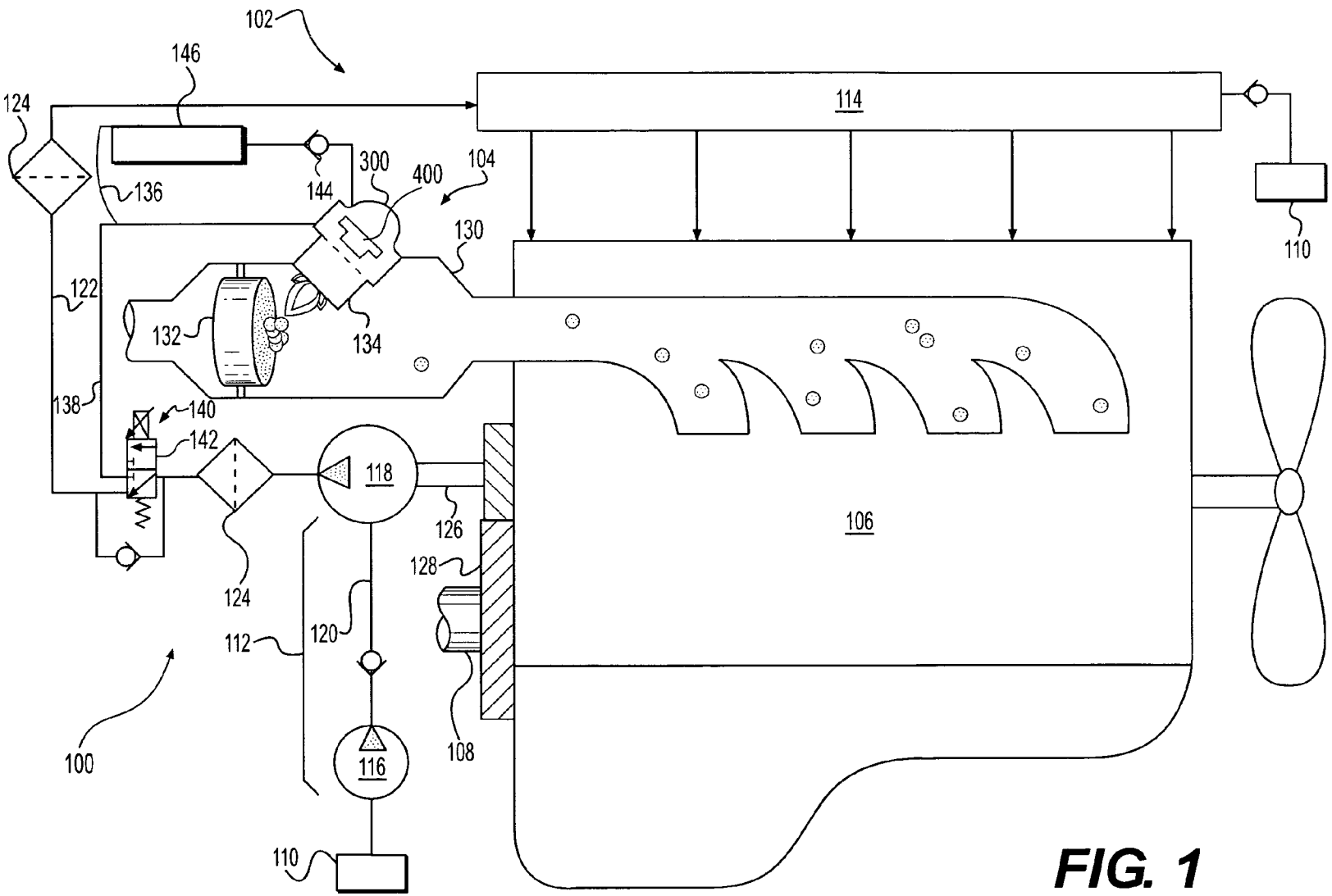
FIG. 1 is a schematic and diagrammatic illustration of an exemplary disclosed power unit.

FIG. 1 illustrates a power unit 100 having a fuel system 102 and an auxiliary regeneration system 104. For the purposes of this disclosure, power unit 100 is depicted and described as a four-stroke diesel engine. One skilled in the art will recognize, however, that power unit 100 may be any other type of internal or external combustion engine such as, for example, a gasoline or a gaseous fuel-powered engine, or a sterling engine. Power unit 100 may include an engine block 106 that at least partially defines a plurality of combustion chambers (not shown). In the illustrated embodiment, power unit 100 includes four combustion chambers. However, it is contemplated that power unit 100 may include a greater or lesser number of combustion chambers and that the combustion chambers may be disposed in an "in-line" configuration, a "V" configuration, or any other suitable configuration.

As also shown in FIG. 1, power unit 100 may include a crankshaft 108 that is rotatably disposed within engine block 106. A connecting rod (not shown) may connect a plurality of pistons (not shown) to crankshaft 108 so that a sliding motion of each piston within the respective combustion chamber results in a rotation of crankshaft 108. Similarly, a rotation of crankshaft 108 may result in a sliding motion of the pistons.

Fuel system 102 may include components that cooperate to deliver injections of pressurized fuel into each of the combustion chambers. Specifically, fuel system 102 may include a tank 110 configured to hold a supply of fuel, and a fuel pumping arrangement 112 configured to pressurize the fuel and direct the pressurized fuel to a plurality of fuel injectors (not shown) by way of a manifold 114. In one embodiment, fuel system 102 may be a common rail system.

Fuel pumping arrangement 112 may include one or more pumping devices that function to increase the pressure of the fuel and direct one or more pressurized streams of fuel to manifold 114. In the common rail example, fuel pumping arrangement 112 may include a low pressure source 116 and a high pressure source 118 disposed in series and fluidly connected by way of a fuel line 120. Low pressure source 116 may embody a transfer pump that provides low pressure feed to high pressure source 118. High pressure source 118 may receive the low pressure feed and increase the pressure of the fuel up to about 300 MPa. High pressure source 118 may be connected to manifold 114 by way of a fuel line 122. One or more filtering elements 124, such as a primary filter and a secondary filter, may be disposed within fuel line 122 in series relation to remove debris and/or water from the fuel pressurized by fuel pumping arrangement 112.

One or both of low and high pressure sources 116, 118 may be operatively connected to power unit 100 and driven by crankshaft 108. Low and/or high pressure sources 116, 118 may be connected with crankshaft 108 in any manner readily apparent to one skilled in the art where a rotation of crankshaft 108 will result in a corresponding driving rotation of a pump shaft. For example, a pump driveshaft 126 of high pressure source 118 is shown in FIG. 1 as being connected to crankshaft 108 through a gear train 128. It is contemplated, however, that one or both of low and high pressure sources 116, 118 may alternatively be driven electrically, hydraulically, pneumatically, or in any other appropriate manner. It is further contemplated that fuel system 102 may alternatively embody another type of fuel system such as, for example, a mechanical unit fuel injector system where the pressure of the injected fuel is generated or enhanced within individual injectors without the use of a high pressure source.

Auxiliary regeneration system 104 may be associated with an exhaust treatment device 130. In particular, as exhaust from power unit 100 flows through exhaust treatment device 130, particulate matter may be removed from the exhaust flow by wire mesh or ceramic honeycomb filtration media 132. Over time, the particulate matter may build up in filtration media 132 and, if left unchecked, the particulate matter buildup could be significant enough to restrict, or even block the flow of exhaust through exhaust treatment device 130, allowing for backpressure within power unit 100 to increase. An increase in the backpressure of power unit 100 could reduce the power unit's ability to draw in fresh air, resulting in decreased performance, increased exhaust temperatures, and poor fuel consumption.

Auxiliary regeneration system 104 may include components that cooperate to periodically reduce the buildup of particulate matter within exhaust treatment device 130. These components may include, among other things, a first housing 300, a combustion canister 134, an injection nozzle 400, and a cooling system 136. It is contemplated that auxiliary regeneration system 104 may include additional or different components such as, for example, one or more pilot injectors, one or more main injectors, a controller, a pressure sensor, a temperature sensor, a flow sensor, a flow blocking device, a source of combustion air, and other components known in the art.

Injection nozzle 400 may be secured to first housing 300 of exhaust treatment device 130, and connected to fuel line 122 by way of a fuel passageway 138 and a main control valve 140. Injection nozzle 400 may be operable to inject an amount of pressurized fuel into combustion canister 134 at predetermined timings, fuel pressures, and fuel flow rates. The timing of fuel injection into combustion canister 134 may be synchronized with sensory input received from a temperature sensor (not shown), one or more pressure sensors (not shown), a timer (not shown), or any other similar sensory devices such that the injections of fuel substantially correspond with a buildup of particulate matter within exhaust treatment device 130. For example, fuel may be injected as the pressure of the exhaust flowing through exhaust treatment device 130 exceeds a predetermined pressure level, or the pressure drop across filtration media 132 exceeds a predetermined differential value. Alternatively or additionally, fuel may be injected as the temperature of the exhaust flowing through exhaust treatment device 130 exceeds a predetermined value. It is contemplated that fuel may also be injected on a set periodic basis, in addition to or regardless of pressure and temperature conditions, if desired.

Main control valve 140 may include an electronically controlled valve element 142 that is solenoid movable against a spring bias in response to a commanded flow rate. Valve element 142 may be movable from a first position, at which pressurized fuel may be directed to manifold 114, to a second position, at which fuel may be directed to auxiliary regeneration system 104. Valve element 142 may be connected to receive electronic signals indicative of which of the first and second positions is desired. It is contemplated that valve element 142 may alternatively be hydraulically or pneumatically actuated in an indirect manner, if desired. It is also contemplated that valve element 142 may be proportionally moved to any position between the first and second positions.

An igniter (not shown), may facilitate ignition of fuel sprayed from injection nozzle 400 into combustion canister 134 during a regeneration event. Specifically, during a regeneration event, the temperature of the exhaust exiting power unit 100 may be too low to cause auto-ignition of the particulate matter trapped within exhaust treatment device 130 or of the fuel sprayed from injection nozzle 400. To initiate combustion of the fuel and, subsequently, the trapped particulate matter, a small quantity (i.e., a pilot shot) of fuel from injection nozzle 400 may be sprayed or otherwise injected toward the igniter to create a readily ignitable locally rich atmosphere. The igniter may ignite the locally rich atmosphere creating a flame, which may be jetted or otherwise advanced from combustion canister 134, toward the trapped particulate matter in filtration media 132. The flame jet propagating from injection nozzle 400 may raise the temperature within exhaust treatment device 130 to a level, which readily supports efficient ignition of a larger quantity (i.e., a main shot) of fuel from injection nozzle 400. As the main injection of fuel ignites, the temperature within exhaust treatment device 130 may continue to rise to a level that causes ignition of the particulate matter trapped within filtration media 132, thereby regenerating exhaust treatment device 130.

During, as well as in-between regeneration events, the temperature of the auxiliary regeneration system's components may rise to undesired temperatures. This rise in temperature can cause coking of residual fuel resulting in fouling of injection nozzle 400. To minimize fouling, coolant may be passed into injection nozzle 400 by way of first housing 300. Specifically, coolant from a coolant supply 146 of cooling system 136 may be pressurized and passed through first housing 300 to injection nozzle 400. As the coolant circulates through first housing 300 and injection nozzle 400, heat may be transferred out of the auxiliary regeneration system 104.

Figure 2:
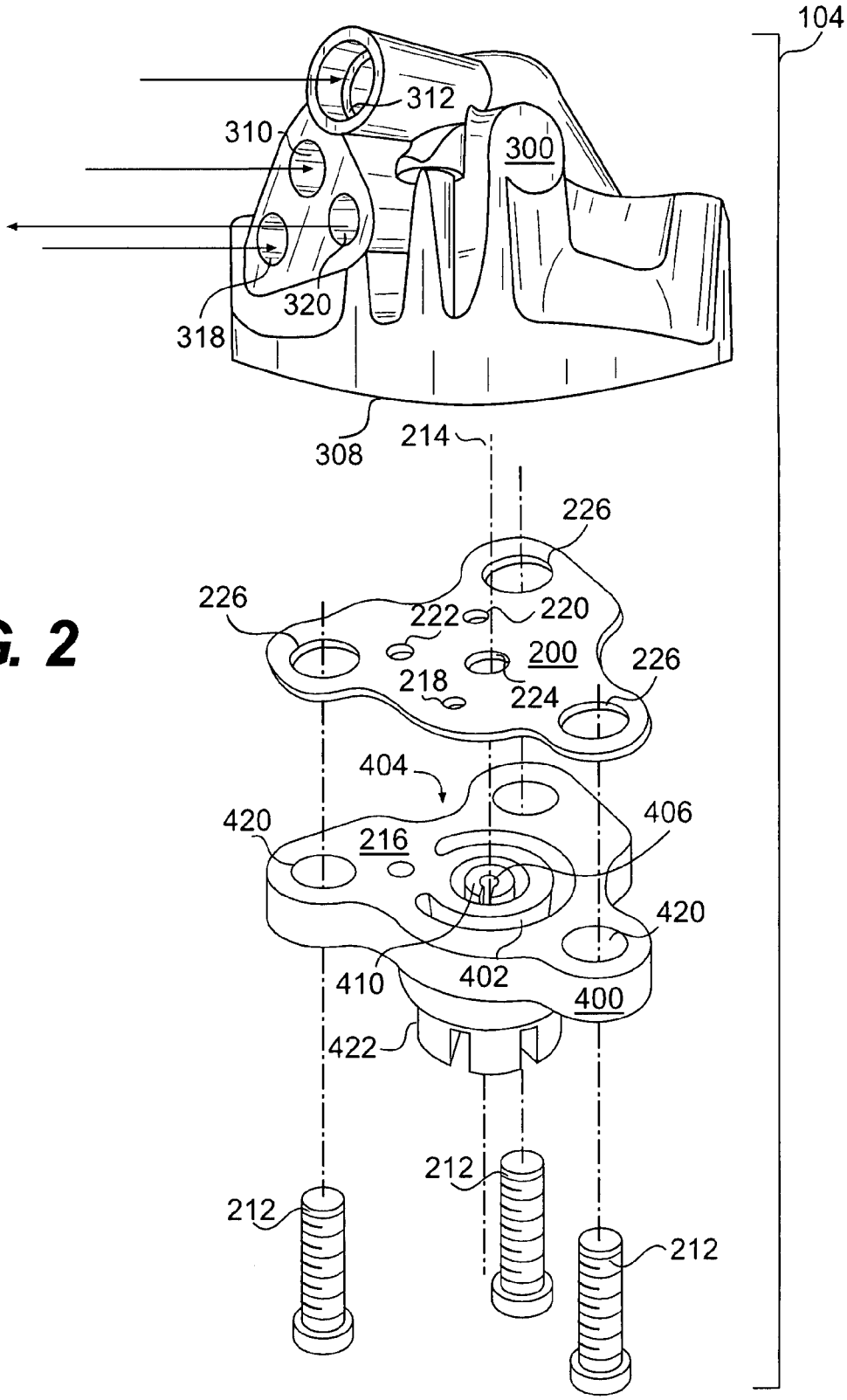
FIG. 2 is an exploded illustration of an exemplary disclosed regeneration device for use with the power unit of FIG. 1.

In addition to cooling injection nozzle 400, heat transfer between first housing 300 and injection nozzle 400 may be minimized. Specifically injection nozzle 400 may be thermally isolated from first housing 300 by way of a thermal barrier 200, as illustrated in FIG. 2. First housing 300 may have a mounting surface 308 located at a fluid supply end of first housing 300. Injection nozzle 400 may have a corresponding mounting surface 216 located at a fluid receiving end of injection nozzle 400. Thermal barrier 200 may be positioned between mounting surfaces 308, 216. Mounting surfaces 308, 216 may both be substantially planer, and generally perpendicular to a central axis 214 of auxiliary regeneration system 104, thereby minimizing the surface area in contact with thermal barrier 200. Because the surface area of housing and nozzle mounting surfaces 308, 216 may be minimized, and thermal barrier 200 may be placed therebetween, the conduction of heat from first housing 300 into nozzle 400, and vice versa, may be minimized. It is contemplated that thermal barrier 200 may be a face seal, or any other suitable barrier that seals and minimizes heat transfer.

Injection nozzle 400 may be secured to first housing 300 with one or more fasteners 212 such as the bolts shown in FIG. 2. Each fastener 212 may be inserted through a corresponding fastener bore 420 of injection nozzle 400, and a fastener opening 226 of thermal barrier 200, to threadingly engage first housing 300 and cause compression of thermal barrier 200. It is contemplated that other means of securing injection nozzle 400 and thermal barrier 200 to first housing 300 may exist and be used in place of, or in addition to fasteners, 212.

Ports may be formed in an exterior surface of first housing 300 to facilitate fluid communication of fuel passageway 138 and cooling system 136 within injection nozzle 400. The ports may be generally circular in geometry, and fluidly communicate via passages within first housing 300 to supply injection nozzle 400 with fuel and coolant. The ports may include, for example, an inlet coolant port 318 and an outlet coolant port 320 to facilitate coolant circulation, as well as a main fuel port 310 and a pilot fuel port 312 to supply fuel.

Figure 3:
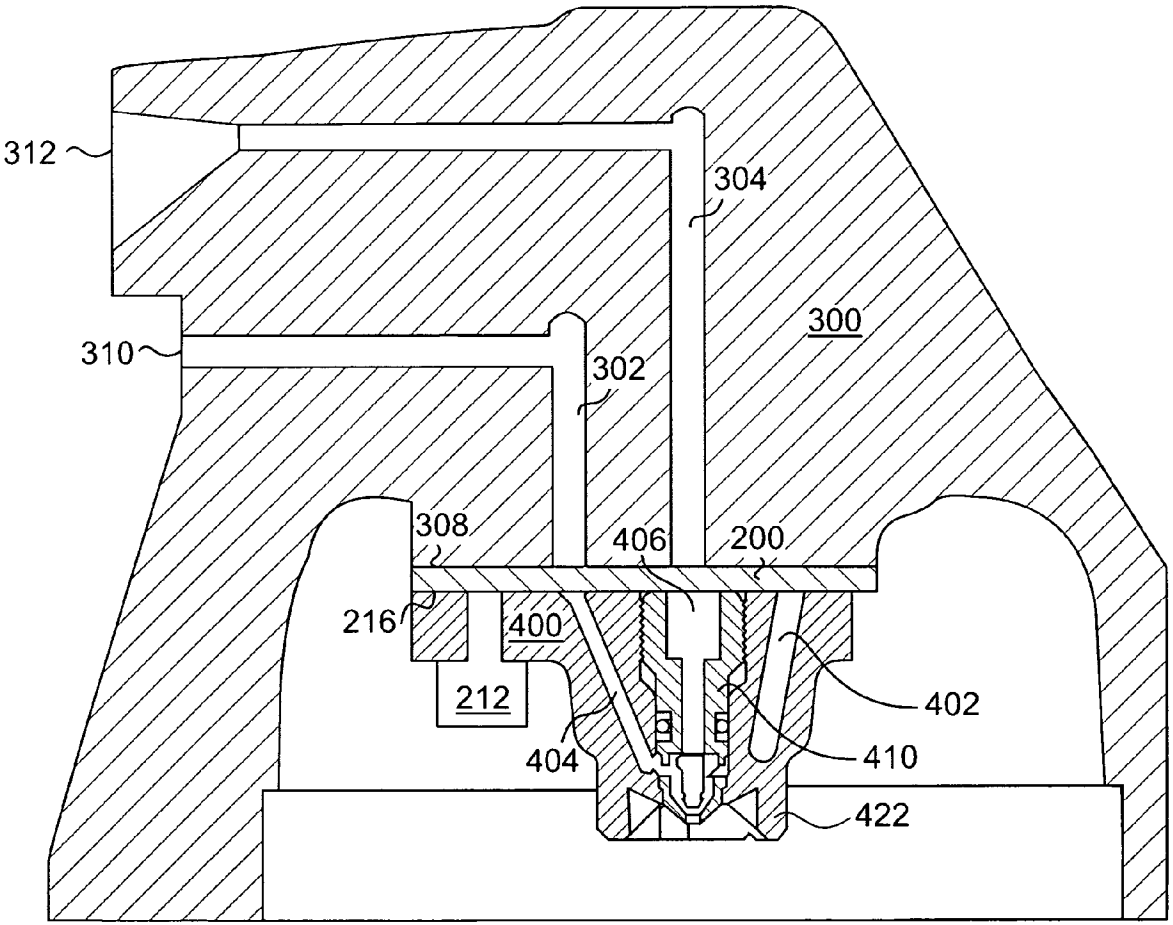
FIG. 3 is a cross-sectional illustration of the regeneration device of FIG. 2.

Illustrated in FIG. 3, first housing 300 may contain passages that connect ports 310, 312, 318, and 320 to openings of thermal barrier 200. In particular, first housing 300 may include a pilot fuel passage 304 in communication with pilot fuel port 312, and a main fuel passage 302 in communication with main fuel port 310. Fuel passageway 138 (referring to FIG. 1) may communicate pressurized fuel to both main fuel passage 302 and pilot fuel passage 304 via main and pilot fuel ports 310, 312. Pilot fuel passage 304 may be generally located on a central axis 214 of auxiliary regeneration system 104 to communicate fuel with a pilot fuel opening 224 of thermal barrier 200, and injection nozzle 400. Similarly, main fuel passage 302 may communicate fuel to the injection nozzle 400 via a main fuel opening 222 of thermal barrier 200. A check valve (not shown) may be disposed within pilot and/or main fuel passageways 304, 302, if desired. This check valve may provide a seal that helps to minimize a trapped fuel volume within pilot and main fuel passages 304, 302.

Inlet and outlet cooling passages (not shown) may also be formed within first housing 300 and be in fluid communication with inlet and outlet coolant ports 318, 320. The inlet and outlet cooling passages may be generally parallel to and radially offset from central axis 214. Coolant may circulate into first housing 300 by flowing through inlet coolant port 318, through inlet cooling passage, and into injection nozzle 400. Coolant may then return from injection nozzle 400, passing through the outlet cooling passage, and outlet coolant port 320 to cooling system 136.

Figure 4:
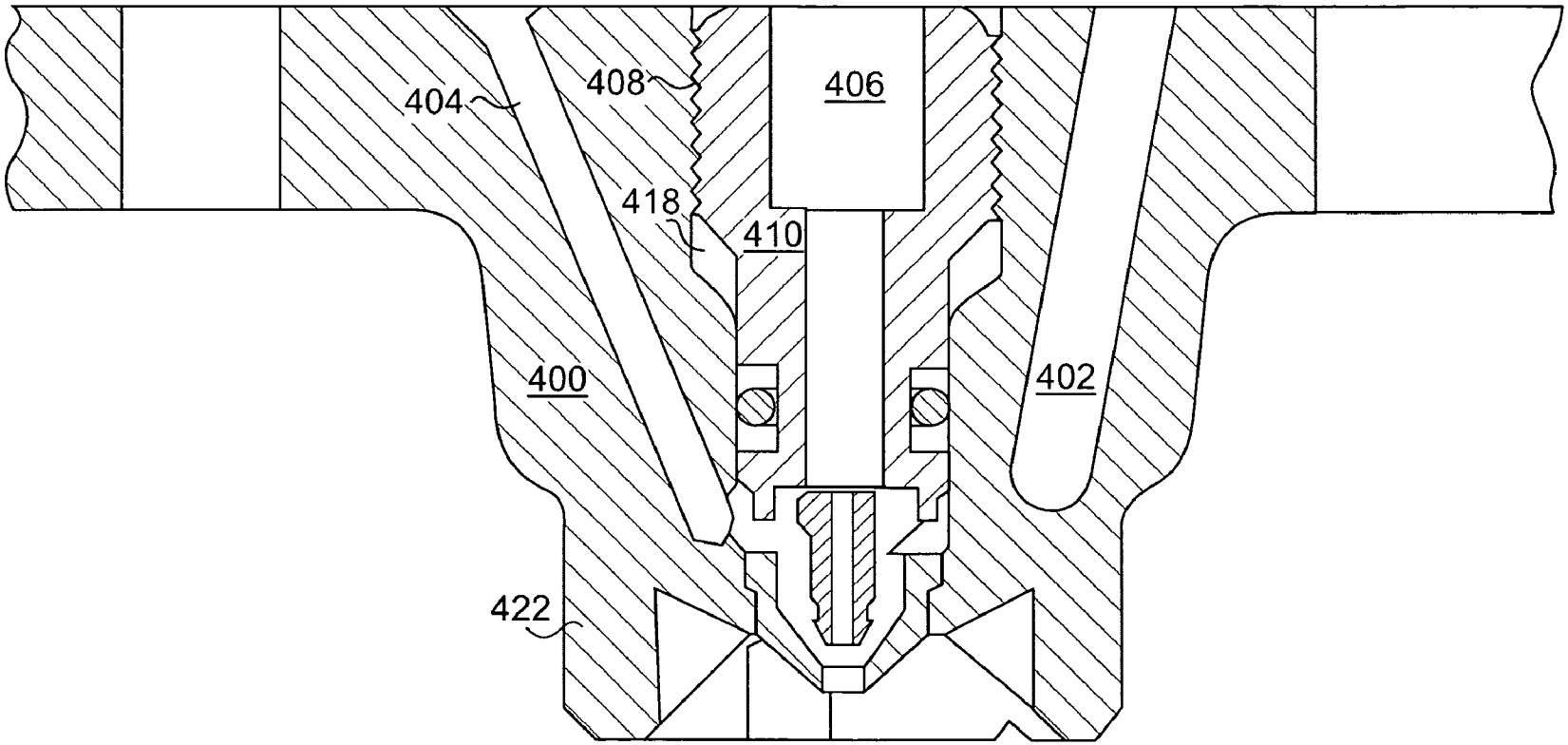
FIG. 4 is a cross-sectional illustration of a housing for use with the regeneration device of FIG. 3.

As illustrated in FIG. 4, injection nozzle 400 may include a stepped bore 418 configured to receive an injector 410, which may be secured by way of threads 408. It is contemplated that injector 410 may be held in place by a means other than threads 408, if desired, such as, for example welding, press fitting, or chemical bonding. A main fuel passage 404 may be oriented to intersect stepped bore 418 at a position radially offset from central axis 214 and substantially tangential to stepped bore 418. That is, the flow of fuel delivered from the main fuel port 310, through main fuel passage 302, main fuel opening 222 of thermal barrier 200, and main fuel passage 404 into stepped bore 418, may avoid immediately passing through a central portion of stepped bore 418. Instead, the fuel may be first directed into contact with an outer cylindrical wall of stepped bore 418. A pilot fuel recess 406 may be positioned on central axis 214, and extend from mounting surface 216 directly into injector 410.

Referring to FIGS. 2-4, a generally annular cooling recess 402 may be formed within the mounting surface 216 of injection nozzle 400. Specifically, cooling recess 402 may embody an annular groove that extends nearly completely around injector 410 in a radial direction, and extends from mounting surface 216 toward a tip end 422 of injection nozzle 400 in an axial direction. Specifically, cooling recess 402 may extend to a point where the bottom of cooling recess 402 may be generally horizontally aligned with an intersection of pilot fuel recess 406 and an orifice tip of injector 410. This depth of cooling recess 402 may also substantially correspond with a depth of main fuel passage 404. Cooling recess 402 may have a larger diameter at mounting surface 216 and taper inward as cooling recess 402 extends toward tip end 422. That is, as cooling recess 402 extends toward tip end 422, cooling recess 402 may taper inward bringing cooling recess 402 closer to injector 410.

Cooling recess 402 may connect at one end to inlet coolant port 318 via an inlet coolant opening 218 of thermal barrier 200. Coolant may then circulate through cooling recess 402, and discharge through outlet coolant port 320 via an outlet coolant opening 220 of thermal barrier 200. Coolant such as, for example, water; glycol; a water/glycol mixture; a power source oil such as transmission oil, engine oil, brake oil, or diesel fuel; a high-pressure fluid such as R-134, propane, nitrogen, or helium; or any other coolant known in the art, may be circulated into and out of injection nozzle 400 via cooling recess 402. As coolant circulates through injection nozzle 400 it may absorb heat from both injection nozzle 400 and injector 410. Thus, injection nozzle 400 and injector 410 may be kept at a suitable temperature to prevent coking of any residual fuel. It is contemplated that the cooling recess 402 may be configured in other ways than described above. For instance, cooling recess 402 may consist of a plurality of passages, rather than a single continuous groove, if desired.

INDUSTRIAL APPLICABILITY

The regeneration device of the present disclosure may be applicable to a variety of exhaust treatment systems including, for example, particulate traps requiring periodic regeneration, catalytic converters requiring a predetermined temperature for optimal operation, and other similar systems known in the art. In fact, the disclosed regeneration device may be implemented into any engine system that benefits from clog-free injector operation. The operation of power unit 100 will now be explained.

Referring to FIG. 1, air and fuel may be drawn into the combustion chambers of power unit 100 for subsequent combustion. Specifically, fuel from fuel system 102 may be injected into the combustion chambers of power unit 100, mixed with the air therein, and combusted by power unit 100 to produce a mechanical work output and an exhaust flow of hot gases. The exhaust flow may contain a complex mixture of air pollutants composed of gaseous and solid material, which can include particulate matter. As this particulate laden exhaust flow is directed from the combustion chambers through exhaust treatment device 130, particulate matter may be strained from the exhaust flow by filtration media 132. Over time, the particulate matter may build up in filtration media 132 and, if left unchecked, the buildup could be significant enough to restrict, or even block the flow of exhaust through exhaust treatment device 130. As indicated above, the restriction of exhaust flow from power unit 100 may increase the backpressure of power unit 100 and reduce the unit's ability to draw in fresh air, resulting in decreased performance of power unit 100, increased exhaust temperatures, and poor fuel consumption.

To prevent the undesired buildup of particulate matter within exhaust treatment device 130, filtration media 132 may be regenerated. Regeneration may be periodic or based on a triggering condition such as, for example, a lapsed time of engine operation, a pressure differential measured across filtration media 132, a temperature of the exhaust flowing from power unit 100, or any other condition known in the art.

To initiate regeneration, injection nozzle 400 may be caused to selectively pass fuel into exhaust treatment device 130 at a desired rate. Fuel may be passed by way of main fuel port 310 and main fuel passage 302 of first housing 300, main fuel opening 222 of thermal barrier 200, and main fuel passage 404 of injection nozzle 400. From injection nozzle 400, the fuel may enter injector 410 to supply a main shot (i.e. a large shot) of fuel into combustion canister 134. Fuel may also be passed through first housing 300 by way of pilot fuel port 312, pilot fuel passage 304, pilot fuel opening 224, of thermal barrier 200, and pilot fuel recess 406 to injector 410. As a pilot injection of fuel from injection nozzle 400 sprays into exhaust treatment device 130, a spark from an igniter may ignite the fuel. As a main injection of fuel from injection nozzle 400 is passed into exhaust treatment device 130, the burning pilot flow of fuel may ignite the main flow of fuel. The ignited main flow of fuel may then raise the temperature of the particulate matter trapped within filtration media 132 to the combustion level of the entrapped particulate matter, burning away the particulate matter and, thereby, regenerating filtration media 132.

The temperature of injection nozzle 400 and injector 410 may be regulated by passing coolant from cooling system 136 through inlet coolant port 318 of first housing 300. From first housing 300, coolant may be passed through inlet cooling opening 218 of thermal barrier 200, into coolant recess 402 of injection nozzle 400. Once inside coolant recess 402, the coolant may circulate through injection nozzle 400 and around injector 410. The coolant may then return to first housing 300 through thermal barrier 200 via outlet coolant opening 220. From first housing 300, coolant may flow through outlet coolant port 320 back to cooling system 136. As the thermal barrier 200 seals mounting surfaces 216, 308 together to prevent fluid leakage, it may also serve to thermally isolate injection nozzle 400 and injector 410 from first housing 300. This thermal isolation may help prevent the conduction of heat from first housing 300 into injection nozzle 400 and injector 410.

It will be apparent to those skilled in the art that various modifications and variations can be made to the regeneration device of the present disclosure without departing from the scope of the disclosure. Other embodiments will be apparent to those skilled in the art from consideration of the specification and practice of the regeneration device disclosed herein. Further, although general examples have illustrated the disclosed regeneration device as being associated with the injection of fuel for particulate regeneration purposes, it is contemplated that the regeneration device may just as easily be applied to the injection of urea and/or AdBlue within a Selective Catalytic Reduction (SCR) device, if desired. It is intended that the specification and examples be considered as exemplary only, with a true scope of the disclosure being indicated by the following claims and their equivalents.

What is claimed is:

1. A regeneration device, comprising:

a first housing having a plurality of passages configured to receive and supply coolant and injection fluid;

a second housing secured to the first housing and configured to receive coolant and injection fluid from the first housing; and at least one cooling recess annularly disposed within the second housing to receive and circulate coolant in the second housing, wherein the plurality of passages in the first housing include:

a main fuel passage fluidly communicating with a main fuel passage in the second housing; and a pilot fuel passage fluidly communicating with a pilot fuel recess within the second housing; and at least one cooling passage fluidly communicating with the at least one cooling recess.

2. The regeneration device of claim 1, further including a combustion canister mounted to the first housing to receive injection fluid from the second housing and discharge an ignited mixture of fuel and air into an exhaust flow.

3. The regeneration device of claim 1, wherein the injection fluid and the coolant are separate fluids, and the coolant is recirculated through the device.

4. The regeneration device of claim 1, further including a thermal barrier located between the first housing and the second housing.

5. The regeneration device of claim 4, wherein the thermal barrier includes a plurality of openings that provides fluid communication between the first housing and the second housing.

6. The regeneration device of claim 1, wherein the first housing and second housing have substantially planer mounting surfaces.

7. The regeneration device of claim 6, wherein the substantially planer mounting surfaces are oriented generally perpendicular to a central axis of the regeneration device.

8. The regeneration device of claim 7, further including an injector disposed within the second housing to inject the injection fluid.

9. The regeneration device of claim 8, wherein the at least one cooling recess includes an annular grove in the substantially planer mounting surface of the second housing.

10. The regeneration device of claim 9, wherein the annular grove extends in an axial direction from the substantially planer mounting surface of the second housing to a depth substantially equal to a depth of an injector supply passage in the second housing.

11. The regeneration device of claim 10, wherein the annular groove tapers in an axial direction toward a central axis of the regeneration device.

12. An exhaust treatment system for a power source, comprising:

an exhaust housing configured to receive exhaust from the power source;

a particulate trap disposed within the exhaust housing and configured to remove particulates from the exhaust;

a coolant supply system; and a regeneration device configured to regenerate the particulate trap, the regeneration device including;

a first housing having a plurality of passages configured to receive a separate supply of the coolant and a fuel, the plurality of passages including at least one fuel passage, a first coolant passage configured to direct the coolant from the coolant supply system into the regeneration device, and a second coolant passage configured to direct the coolant from the regeneration device to the coolant supply system;

a second housing secured to the first housing and configured to receive the fuel and the coolant separately from the first housing; and at least one cooling recess annularly disposed within the second housing to receive the coolant from the first coolant passage and direct the coolant to the second coolant passage.

13. The exhaust treatment device of claim 12, wherein the first housing and second housing have substantially planer mounting surfaces.

14. The exhaust treatment device of claim 13, wherein the substantially planer mounting surfaces are oriented generally perpendicular to a central axis of the regeneration device.

15. The exhaust treatment device of claim 14, further including a thermal barrier positioned between the substantially planer mounting surfaces of the first housing and the second housing, and perpendicular to the central axis of the regeneration device.

* * * * *